United States Patent [19]

DeCaro et al.

[11] 4,370,589

[45] Jan. 25, 1983

[54] FILAMENT CONNECTOR MEANS FOR ELECTRIC INCANDESCENT LAMP

[75] Inventors: Aristide R. DeCaro, Edison; Henry M. Nixon, Westfield, both of N.J.

[73] Assignee: Westinghouse Electric Corp., Pittsburgh, Pa.

[21] Appl. No.: 182,923

[22] Filed: Sep. 2, 1980

[51] Int. Cl.[3] ..... H01K 1/42; H01K 9/08

[52] U.S. Cl. ..... 313/315; 313/332; 313/331; 313/309

[58] Field of Search ..... 313/351, 309, 333, 332, 315

[56] References Cited

U.S. PATENT DOCUMENTS

| | | | |
|---|---|---|---|
| 2,145,186 | 1/1939 | Meeker et al. | 313/333 |
| 2,191,189 | 2/1940 | Wade | 313/351 X |
| 2,249,672 | 7/1941 | Spanner | 313/351 X |
| 2,345,641 | 4/1944 | Van Sant | 313/351 X |
| 2,632,126 | 3/1953 | Curtis | 313/333 X |
| 3,361,924 | 1/1968 | Agdur et al. | 313/351 X |

*Primary Examiner*—Saxfield Chatmon, Jr.
*Attorney, Agent, or Firm*—D. S. Buleza

[57] ABSTRACT

The inner ends of the lead-in wires of an electric incandescent lamp are serrated and welded to uncoiled leg portions of the tungsten filament so that the members are fused to one another at a plurality of spaced points or locations and provide strong reliable electrical junctures. The filament leg portions are in bridging relationship with the serrations on the ends of the lead wires and form high-resistance areas of contact during the welding operation that permits high-quality welds to be made efficiently without the use of a flux material, even in halogen-cycle type lamps that require the welding of molybdenum lead wires to a tungsten filament.

7 Claims, 8 Drawing Figures

FILAMENT CONNECTOR MEANS FOR ELECTRIC INCANDESCENT LAMP

BACKGROUND OF THE INVENTION

This invention generally relates to electric lamps and has particular reference to an improved incandescent lamp having filament-lead wire junctures that facilitate lamp manufacture and enhance product quality.

The standard practice in the incandescent lamp industry with regard to electrically connecting the tungsten filament coil to the lead-in wires is to either clamp the inner ends of the lead wires around the ends of the filament or provide the filament coil with leg portions that are welded to the leads. Clamped connections are rather costly and time consuming and are also somewhat critical since they require careful control of the clamping operation to prevent crushing or breaking the filament while, at the same time, avoiding loose clamps and unreliable junctures. Welding of the filaments to the lead wires is accordingly more prevalent but it also entails production and quality problems, particularly in the manufacture of compact halogen-cycle incandescent lamps which have molybdenum inner lead wires and thus require tungsten-to-molybdenum welds to fasten the end portions of the filament to the respective leads. In order to reduce the incidence of poor welds, a suitable flux such as platinum (either in the form of a foil or a coating on the molybdenum leads) must be used when making such welds. This, of course, further complicates lamp manufacture and increases the cost.

A filament connection for an electric incandescent lamp wherein the leg portions of a coiled tungsten filament are welded to one or more transverse ridge portions that are provided on each of the ends of nickel lead wires which are also flattened and specially configured is disclosed in U.S. Pat. No. 2,227,324 granted Dec. 31, 1940 to Severin. A similar filament connection which also employs specially-flattened lead wire ends and includes a groove or V-recess in the tips of the lead wires to provide additional support for the filament legs is disclosed in U.S. Pat. No. 2,632,126 issued Mar. 17, 1953 to Curtis.

The use of lead wires having flattened ends or which are constructed from two different kinds of metal to facilitate electrical connection with the ends of the filament are disclosed in U.S. Pat. Nos. 324,038 to Moses and U.S. Pat. No. 508,659 to Thomson. An incandescent lamp wherein the ends of the tungsten filament are embedded in the fused ends of the lead wires which are melted with the aid of a flux is disclosed in U.S. Pat. No. 1,022,554 to Howell. A method of making a welded juncture for the cathode of an electron tube by using tabs of platinum and tantalum which serve as flux materials and permit a tungsten filament to be welded to a tungsten lead is disclosed in U.S. Pat. No. 2,341,716 issued Feb. 15, 1944 to Herdman.

SUMMARY OF THE INVENTION

In accordance with the present invention, a rugged and very reliable electrical connection between the leg portion of a tungsten lamp filament and its associated lead-in conductor is achieved in a very practical and inexpensive manner by providing the end of the conductor with a series of "teeth" or serrations which are so spaced and oriented so that the filament leg bridges several of the serrations and rests on the "tips" or crowns of the individual serrations when the members are positioned in aligned and overlapping relationship prior to the welding operation. A series of "high resistance" contact areas are thus inherently established during the welding operation which concentrates the welding current at localized points along the conductor with the result that the filament leg is pressed into and firmly embedded in the heat-softened or melted crown portions of the individual serrations. This not only greatly facilitates the welding operation (since it reduces the quantity of lead-in conductor material that must be resistively heated by the welding current) but inherently forms a series of welds at a plurality of spaced locations along the length of the lead-in conductor. The resulting juncture is thus very strong and reliable and permits tungsten filaments to be welded directly to molybdenum lead wires without the use of any flux, such as platinum. This is of great advantage in the manufacture of compact halogen-cycle incandescent lamps of the type used in automotive headlamps since tungsten-to-molybdenum welds are required and the filament-lead wire junctures are subjected to severe vibrations and rough service conditions.

The fact that serrations of the proper profile and spacing can be easily formed on the curved surface of a lead wire is also an important advantage since it eliminates the need for flattening or otherwise pretreating the lead wires.

BRIEF DESCRIPTION OF THE DRAWINGS

A better understanding of the invention will be obtained from the exemplary embodiments shown in the accompanying drawings, wherein.

DESCRIPTION OF THE PREFERRED EMBODIMENTS

While the present invention can be used with advantage in various kinds of incandescent lamps that have filaments with leg portions that are welded to the lead-in conductors within the lamp envelope, it is especially adapted for use in halogen-cycle type incandescent lamps currently being employed as inner lamp components for sealed-beam headlamps and it accordingly has been so illustrated and will be so described.

Figure 1:
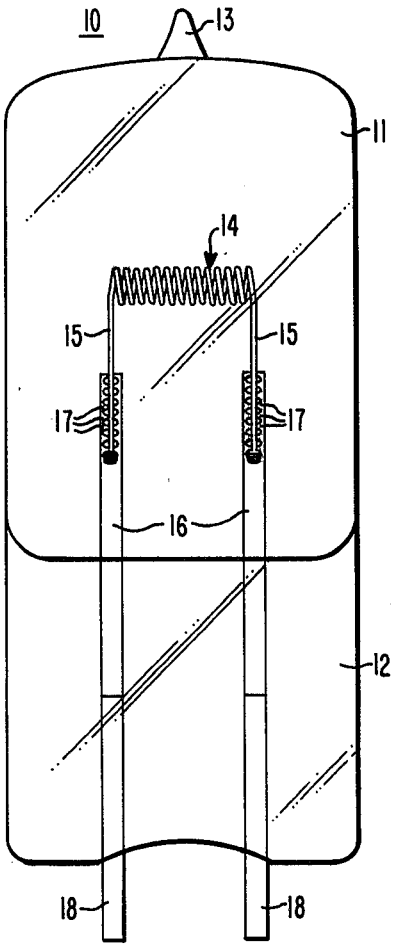
FIG. 1 is an enlarged front elevational view of a compact halogen-cycle type incandescent lamp that embodies the present invention.
Figure 2:
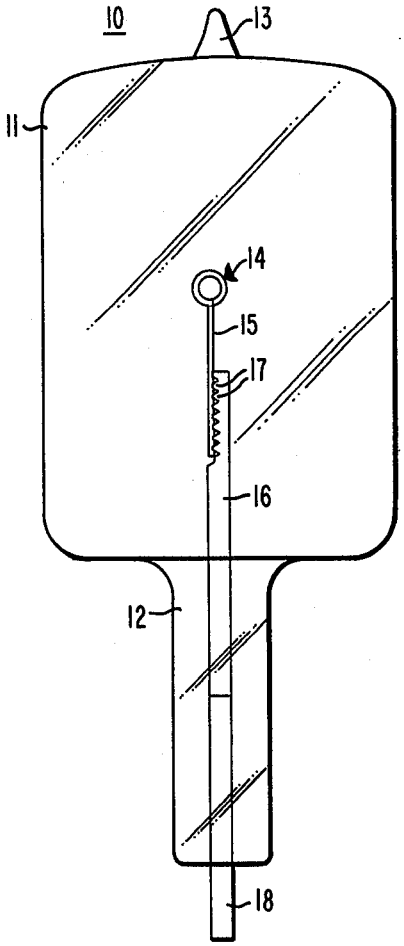
FIG. 2 is a side elevational view of the lamp shown in FIG. 1.

A compact halogen-cycle incandescent lamp 10 of the foregoing type is shown in FIGS. 1 and 2 and comprises a tubular envelope 11 of suitable hard glass (such as an aluminosilicate or borosilicate type glass well known to those in the art) that contains a coiled filament 14. The envelope is terminated at one end by a press seal 12 of fused glass and at its opposite end by a sealed tip 13 which constitutes the residue of a tubulation through which the lamp is evacuated, charged with an inert fill gas (such as argon) and dosed with a controlled amount of a suitable halogen (such as iodine or bromine). The filament 14 is wound from wire that is composed essentially of tungsten and has a helical coiled body portion that is disposed transverse to the longitudinal axis of the lamp 10 and is held in such position by a pair of uncoiled leg segments 15 that are welded to the ends of a pair of inner lead-in conductors 16 that are composed of molybdenum and are substantially rigid. The lead-in conductors 16 are preferably made in the form of wires of circular cross-section that extend into and are anchored in the fused glass seal 12 where they are joined (as by butt-welds) to a pair of outer lead-in conductors 18 that are also anchored in the seal and protrude from the end of the envelope 12. Since the outer leads 18 are not subjected to the halogen atmosphere and high temperature conditions which exist within the envelope 12, they can be fabricated from nickel, nickel-plated iron or any other suitable metal that can be readily sealed to the glass from which the envelope is made.

Figure 3:
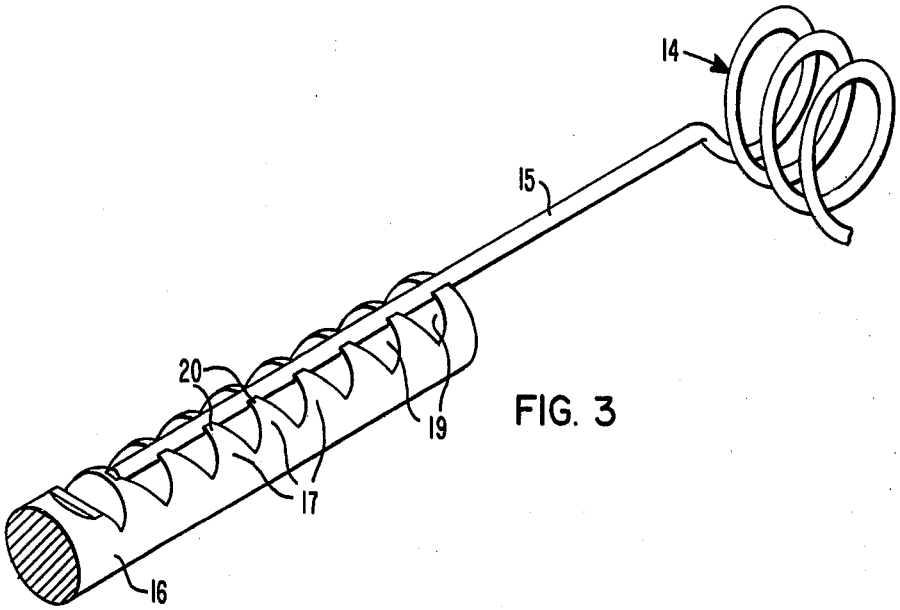
FIG. 3 is an enlarged fragmentary pictorial view of one of the filament-lead wire junctures employed in the incandescent lamp shown in FIGS. 1 and 2.
Figure 4:
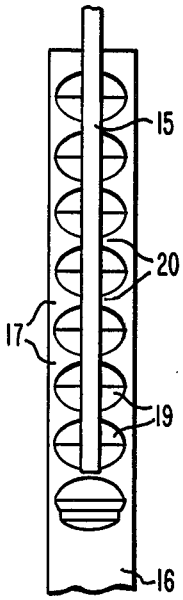
FIGS. 4 and 5 are plan and side views, respectively, of the filament-lead wire juncture shown in FIG. 3.
Figure 5:
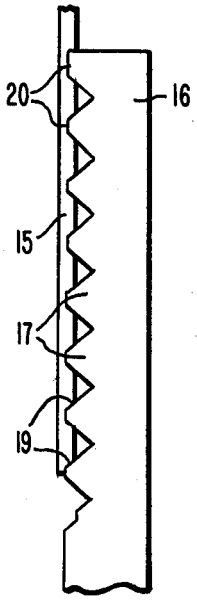

In accordance with the present invention, the end segments of the inner lead-in wires 16 that are joined to the filament legs 15 are serrated to provide a series of uniformly and closely spaced "teeth" or serrations 17 that extend transversely across the respective lead wires so that the associated filament leg portions are positioned in bridging relationship with a number of the serrations. As shown more clearly in FIGS. 3–5, the leg portions 15 of the coiled filament 14 are substantially straight and are partly embedded in the "tips" or crowns 20 of the serrations 17 by virtue of the fact that the welding current and heat is concentrated at these points rather than being spread along the entire length of the conductor 16. As will be noted, the lead wires 16 are much larger than the filament legs 15 so that the latter overlie and are welded to only the medial part of the serrated ends of the lead wires. The filament legs 15 are aligned with the serrated ends of the lead-in wires 16 and are in bridging relationship with the individual serrations 17 (as shown in FIG. 4) so that the legs are securely welded to the lead wires at a series of spaced points or locations.

The filament legs 15 are also of such length that they bridge and are fused to at least three or more of the serrations 17 on each of the lead wires 16, as illustrated.

Figure 6:
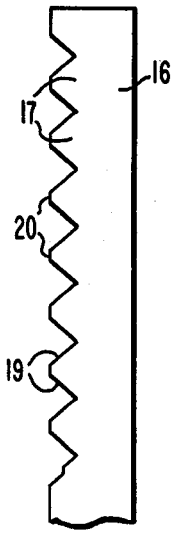
FIG. 6 is a side elevational view of the serrated end of the lead wire prior to the welding operation.

As shown in FIG. 6, the serrations 17 provided on the inner end segments of the lead-in wires 16 are defined by a series of equally spaced V-shaped notches or recesses 19 that can be readily formed in the lead wires by a suitable tool. The recesses 19 are deep and wide enough to provide narrow crown portions 20 that are sufficiently small (in terms of area and volume) to create the required "high-resistance" contact regions during the welding operations and also permit the crown portions to fuse quickly to the filament legs 15 when the welding current is applied. As is also disclosed in FIG. 6, the spacing of the recesses 19 relative to their depth is such that the narrow crown portions 20 of the serrations 17 have flat rather than pointed tips.

While the serrations 17 as illustrated are provided on the end segments of lead-in wires 16 that are circular in cross section, it is within the scope of the invention to provide the serrations on lead wires of different configuration (elliptical cross-section for example).

Even though the filament leg-lead wire welds as illustrated and described are made without the use of any type of flux metal or material, it is also within the scope of the invention to use a flux agent if desired. In the case of tungsten-to-molybdenum welds, a strip of platinum foil can be interposed between the serrated end of the lead wire and the filament leg prior to the welding operation. Alternatively, a thin coating of platinum can be applied to the end of the lead wire 16, either before or after the serrations 17 have been formed, to serve as a flux.

ALTERNATIVE LAMP EMBODIMENT (FIGS. 7–8)

Figure 7:
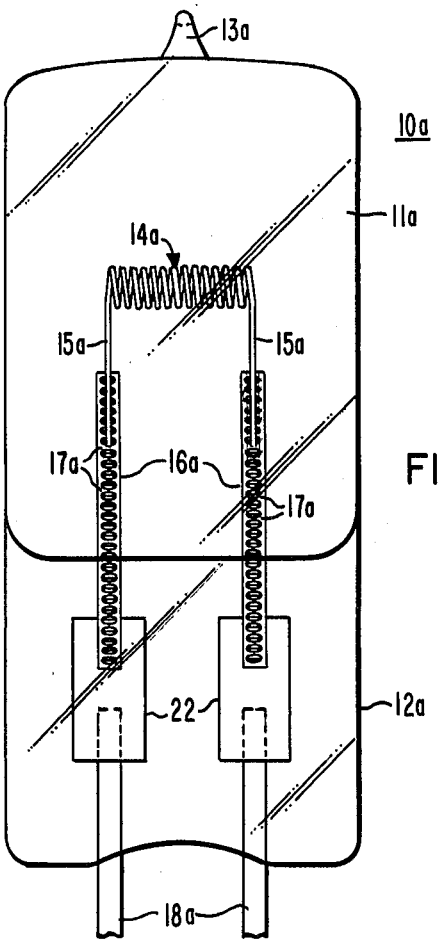
FIG. 7 is a front elevational view of an alternative halogen-cycle incandescent lamp embodiment wherein the inner lead wire component is serrated along its entire length.

The invention is not limited to incandescent lamps that have envelopes which are composed of glass and thus permit the use of "two-piece" leads but can also be employed in halogen-cycle type incandescent lamps that are constructed with quartz envelopes and require a "ribbon-type" seal. Such a lamp **10*a* is shown in FIG. 7 and is identical with that previously described except that the tubular envelope 11*a* is composed of quartz and the outer lead-in wires 18*a* are electrically connected to the inner lead wires 16*a* by a pair of metal foils or ribbons 22 of molybdenum or the like that are hermetically embedded in the press seal 12*a***.

Figure 8:
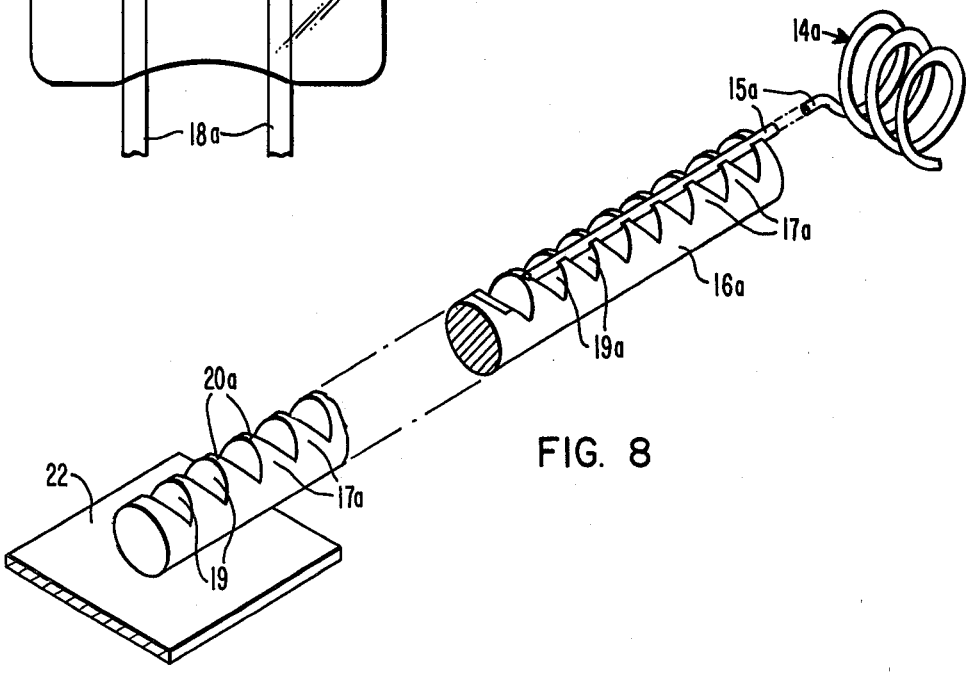
FIG. 8 is an enlarged fragmentary view of the filament-lead wire juncture and ribbon connector employed in the alternative lamp embodiment shown in FIG. 7.

In addition, in accordance with this embodiment the inner lead-in conductors **16*a* are serrated along their entire lengths so that the fused quartz flows into and forms a mechanical interlock with the serrations 17*a* that are located on the parts of the conductors 16*a* which are embedded in the seal 12*a*. The inner leads are thus anchored in the press seal in a more secure fashion and the lamp $10_a$ is rendered more shock-resistant. As shown more particularly in FIG. 8, each of the filament legs 15*a* is welded in countersunk and bridging relationship with the crowns 20*a* of three or more individual serrations 17*a* provided on the lead-in wire and the metal ribbons 22** are welded or otherwise joined to sides of the lead-in wires that are not serrated.

If desired, the inner leads 16 of the "hard glass" type incandescent lamp 10 shown in FIGS. 1 and 2 can also be serrated along their entire length to anchor the leads in the press seal 13 in a more secure manner and thus enhance the ruggedness of the finished lamp.

As will also be apparent to those skilled in the art, the invention can be employed in incandescent lamps of "double-ended" construction if desired and the inner lead-in conductors can also be made of other suitable metals instead of molybdenum.

We claim as our invention:

1. In an electric incandescent lamp having a sealed light-transmitting envelope, the combination of;

a filament of refractory metal wire having a coiled body portion and uncoiled leg portions that extend laterally from and terminate said coiled body portion, a pair of substantially rigid lead-in wires extending into said envelope and having inner end segments that are disposed in aligned overlapped relationship with the respective uncoiled leg portions of the filament, and means electrically connecting the uncoiled leg portions of the filament to the associated overlapped end segments of said lead-in wires comprising a plurality of spaced serrations on each of the end segments of the lead-in wires that are welded to said leg portions, said serrations extending transversely across the respective lead-in wire segments and being so spaced and dimensioned that the filament leg portions are in bridging relationship with a plurality of the serrations on the associated lead-in wire segments and are also fused to only the crowns of the bridged serrations so that the filament is thereby securely fastened to each of the lead-in wires at a series of spaced locations along the respective lead-in wires.

2. The electric incandescent lamp of claim 1 wherein said serrations are defined by a series of spaced V-shaped notches in the lead-in wire segments of such width and depth that the individual serrations have tapered sides and crowns with flat tips.

3. The electric incandescent lamp of claim 1 or 2 wherein;

the inner end segments of said lead-in wires are substantially straight, disposed in side-by-side relationship, and of circular or elliptical cross-section, and the laterally-extending filament leg portions comprise substantially straight uncoiled lengths of filament wire that are also disposed in side-by-side relationship.

4. The electric incandescent lamp of claim 1, 2 or 3 wherein said wire filament is essentially composed of tungsten, said lead-in wires are composed of molybdenum, and the welds joining the lead-in wire serrations and filament leg portions to one another are devoid of fluxing material.

5. The electric incandescent lamp of claim 3 wherein;

said envelope is composed of vitreous material and has an hermetic seal of fused vitreous material formed on one end, the pair of lead-in wires are anchored in said hermetic seal, and the parts of said lead-in wires that are anchored in the fused hermetic seal also have transversely-extending serrations which are mechanically interlocked with the sealed end of the envelope.

6. The electric incandescent lamp of claim 4 wherein;

said vitreous envelope is composed of hard glass or quartz and contains a halogen which provides a regenerative cycle within the lamp during operation that returns vaporized tungsten to the coiled body portion of the filament, and said halogen, in combination with the multiple flux-free welds joining the tungsten filament legs to the molybdenum lead-in wires, provides a halogen-cycle type incandescent lamp that is especially suited for use as an inner lamp component for a sealed-beam headlamp or similar vehicular lighting apparatus.

7. The halogen-cycle incandescent lamp of claim 6 wherein;

the coiled body portion of the tungsten-wire filament comprises a helix that extends transversely relative to the longitudinal axis of the lamp, said envelope has a press seal at one end in which the molybdenum lead-in wires are anchored, the uncoiled filament leg portions both extend toward the sealed end of the envelope, and the serrated end segments of the molybdenum lead-in wires are of such size relative to the associated filament leg portions that said leg portions are welded to and are partly embedded in only a medial portion of the flat tips of the crowns of the associated individual serrations.

* * * * *